United States Patent [19]

Valka et al.

[11] Patent Number: 4,969,517

[45] Date of Patent: Nov. 13, 1990

[54] SUB-MUDLING CASING HANGER/PACKOFF

[75] Inventors: William A. Valka, Spring; Glen C. Wieland, Houston, both of Tex.

[73] Assignee: FMC Corporation, Chicago, Ill.

[21] Appl. No.: 398,862

[22] Filed: Aug. 25, 1989

[51] Int. Cl.[5] ..... E21B 33/04

[52] U.S. Cl. ..... 166/208; 166/142

[58] Field of Search ..... 166/124, 126, 128, 142, 166/152, 208, 289, 290, 330

[56] References Cited

U.S. PATENT DOCUMENTS

| | | | |
|---|---|---|---|
| 2,616,503 | 11/1952 | Armentrout | 166/11 |
| 3,223,159 | 12/1965 | Brown | 166/21 |
| 3,260,309 | 7/1966 | Brown | 166/208 X |
| 3,405,763 | 10/1968 | Pitts et al. | 166/48 |
| 3,736,984 | 6/1973 | Garrett | 166/208 |
| 3,920,075 | 11/1975 | Braddick et al. | 166/290 |
| 4,046,405 | 9/1977 | Bonds | 285/3 |
| 4,171,018 | 10/1979 | Walker | 166/315 |
| 4,349,071 | 9/1982 | Fish | 166/124 |
| 4,406,325 | 9/1983 | Bowyer | 166/214 |
| 4,408,784 | 10/1983 | Reimert | 285/24 |
| 4,465,133 | 8/1984 | Bridges | 166/208 |
| 4,508,167 | 4/1985 | Weinberg et al. | 166/120 |
| 4,510,995 | 4/1985 | Krause, Jr. et al. | 166/217 |
| 4,597,448 | 7/1986 | Baugh | 166/348 |
| 4,653,589 | 3/1987 | Alandy | 166/382 |
| 4,665,979 | 5/1987 | Boehm | 166/208 |
| 4,757,860 | 7/1988 | Reimert | 166/208 |
| 4,807,705 | 2/1989 | Henderson et al. | 166/348 |
| 4,834,176 | 5/1989 | Rentroe, Jr. | 166/142 |

*Primary Examiner*—William P. Neuder

*Attorney, Agent, or Firm*—W. William Ritt, Jr.; Richard B. Megley

[57] ABSTRACT

A well casing hanger/packoff apparatus with ports through which fluids can be circulated during installation and cementing operations, and a sleeve-type valve that can be moved axially to open or close the ports as desired.

9 Claims, 6 Drawing Sheets

SUB-MUDLING CASING HANGER/PACKOFF

BACKGROUND OF THE INVENTION

This invention relates to well pipe hangers and their seals, and more particularly to liner hangers and packoffs for use in subsea wells.

During the process of drilling an oil or gas well a plurality of casing strings, each comprising lengths of pipe joined together in end-to-end fashion, are installed concentrically in and cemented to the well bore to prevent undesired entry of fluids residing in the surrounding earth strata and, in many instances, to prevent cave-in of the well which can occur if, for example, it penetrates loose sand or other types of unconsolidated formations. Usually each casing string is supported at and extends downward from the wellhead, but there are occasions when it is desireable to install a special casing, called a liner, that extends downwardly from near or at the lower end of the previously installed next larger casing. The liner is supported or hung on that casing by a hanger, and the annulus between the liner and the casing is sealed with cement and/or an annular assembly called a packer or packoff.

Prior to the present invention one of the problems with liner hangers is that they do not offer the ability to open ports for circulating fluids past the hanger while cementing the liner in place, and then close those ports once the cementing operation is finished. If the liner hanger is run into the well with a packer once the packer is set there is either no way to circulate cement past the packer to assure a seal or with a retrievable packer, without first retrieving the packer the hanger and the packer which consumes substantial, costly rig time. If no packer is used, reliance must be solely on the cement to establish the required seal, and problems with effecting a satisfactory seal by cement alone are well known in the drilling industry.

SUMMARY OF THE INVENTION

The present invention solves the foregoing problems by providing a novel casing hanger/packoff combination that includes ports through which fluids can be circulated during installation and cementing operations, and a sleeve-type porting valve element that can be moved axially to open or close the ports as desired. The hanger has an axially split, expandable ring that cooperates with a housing adapter in the casing to suspend or hang the liner from the casing, and the packoff includes annular resilient seal elements that are expanded into fluid-tight contact with the housing adapter as the hanger/packoff is landed and set in the adapter. The hanger/packoff of this invention can be run into the well, and the sleeve valve can be moved later to open or close the ports at the proper time. Further, a hanger/packoff according to this invention enables the liner to be reciprocated to enhance the cementing operation, thus increasing the chances of obtaining a satisfactory cement bond between the liner and the surrounding well bore.

DESCRIPTION OF THE PREFERRED EMBODIMENT

Figure 1:
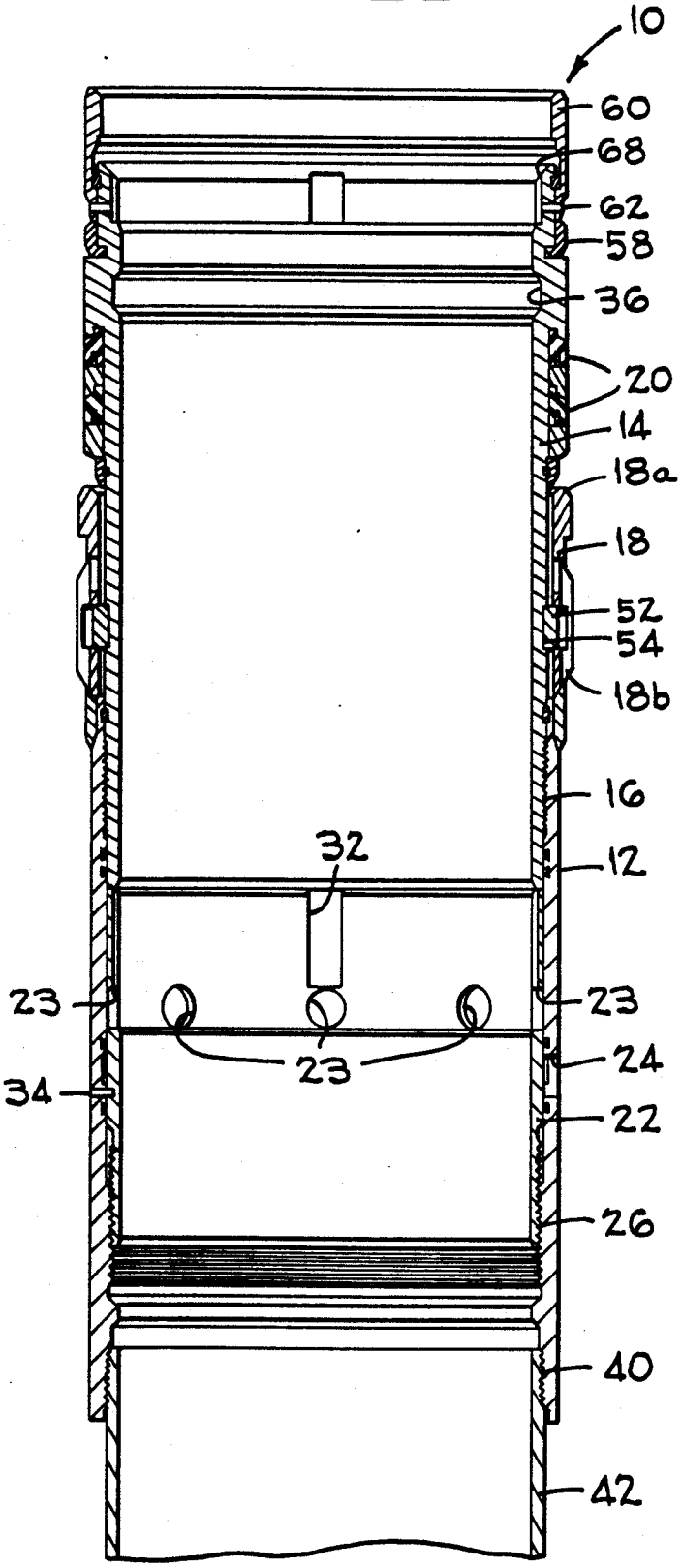
FIG. 1 is a view in central vertical section of a casing hanger/packoff according to the present invention.
Figure 3:
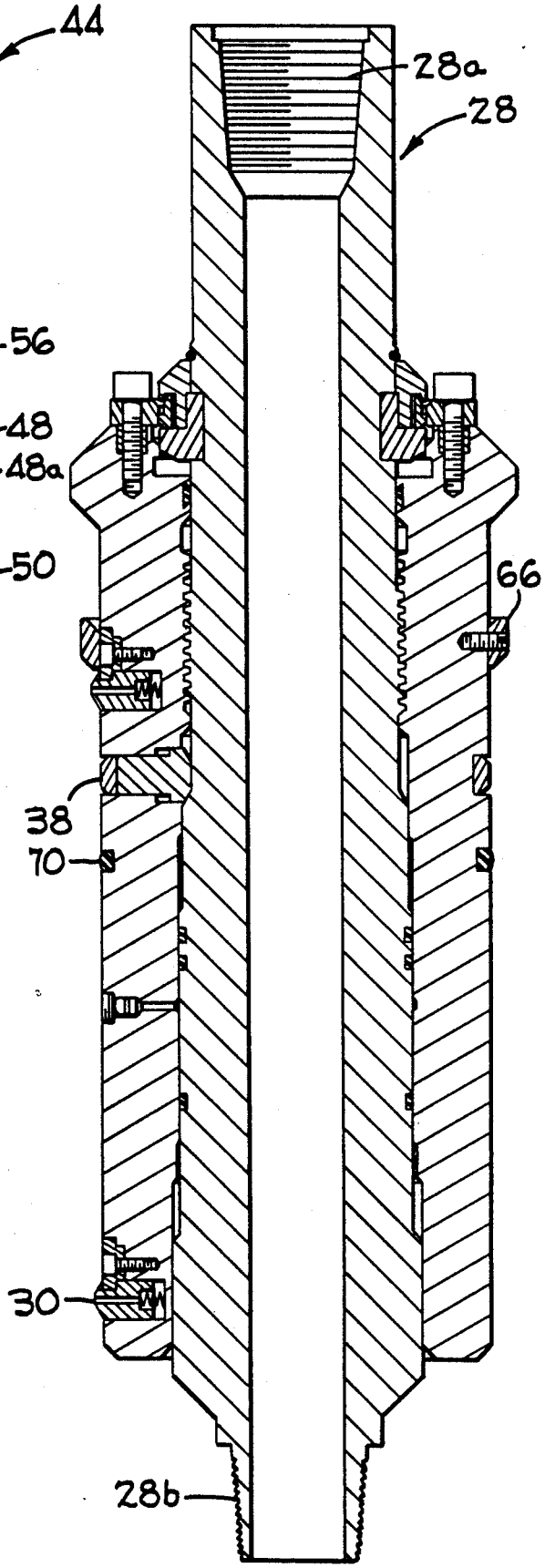
FIG. 3 is a view in central vertical section of a tool for running landing, and setting the hanger/packoff of FIG. 1 in the adapter of FIG. 2.

As illustrated best in FIG. 1, a hanger/packoff 10 according to the present invention generally comprises a hanger body 12, a packoff body 14 threadedly connected at 16 to the hanger body 12, an expandable split landing ring 18 surrounding the packoff body 14 above the hanger body 12, one or more (two shown) annular resilient seal elements 20 surrounding the packoff body 14 above the landing ring 18, and a porting valve sleeve 22, having circulation ports 23, within the hanger body 12 for opening and closing a plurality of circumferentially spaced circulation ports 24 (only one shown) in the hanger body. The porting sleeve 22 is threaded to the hanger body 12 at 26, whereby the sleeve can be moved axially between its "closed" position, shown in FIGS. 1 and 4–6, and its "open" position, shown in FIG. 7, by rotation of the sleeve with a running tool 28 (FIG. 3) which has a spring-biased key 30 at its lower end that engages any one of a plurality of circumferentially spaced axial slots 32 in the upper portion of the sleeve. The sleeve 22 is releasably secured to the hanger body 12 by a plurality of circumferentially spaced shear pins 34 (only one shown) which fracture when the tool 28 is rotated. The upper portion of the packoff body 14 has an inner annular groove 36 for cooperating with a split expandable lock ring 38 (FIG. 3) on the running tool 28 to releasably secure the tool to the hanger/packoff 10 as seen in FIGS. 4–6, and the lower portion of the hanger body 12 contains internal threads 40 for securing the hanger/packoff to the upper end of a liner or other pipe 42.

Figure 2:
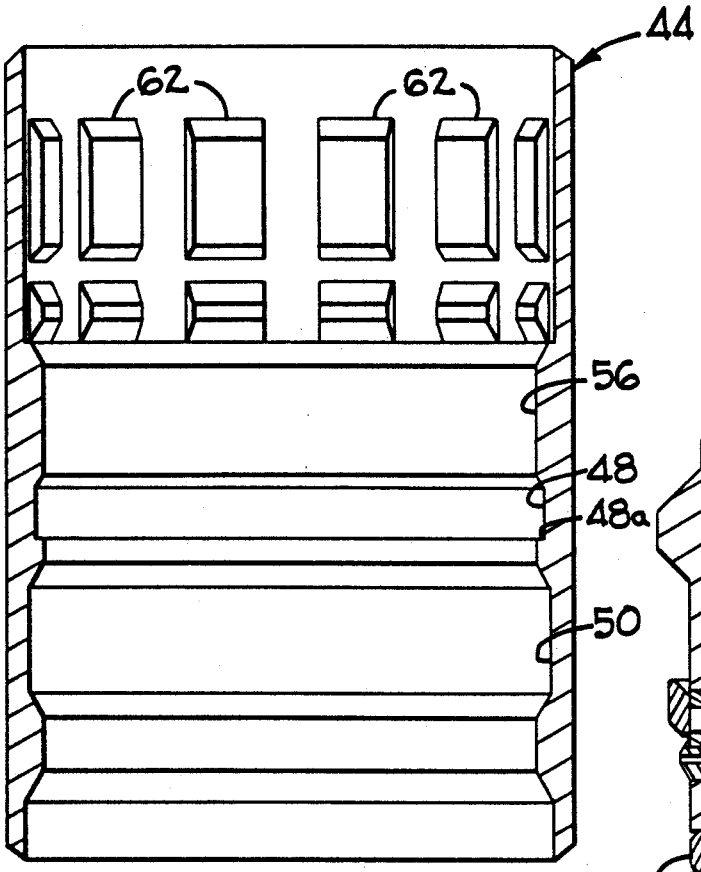
FIG. 2 is a view in central vertical section of a housing adapter with which the hanger/packoff cooperates for suspending a liner from an outer casing in a well.

An annular adapter housing 44, seen best in FIG. 2, functions to provide a support means in an outer casing 46 (FIGS. 4–7) for suspending the hanger/packoff 10, and thus the liner 42, at a predetermined location in the well. The adapter housing 44 includes an inner annular landing groove 48 with a profile essentially complementary to that of the upper portion **18*a* of the landing ring 18, and a lower key groove 50 with a profile essentially complementary to that of the landing ring lower portion 18*b*. As the hanger/packoff 10 is lowered into the housing adapter 44 the landing ring 18 will come to rest on the upwardly facing shoulder 48*a* of the groove 48, and continued downward movement of the hanger/packoff results in further expansion of the landing ring into its final position in the grooves 48, 50 as seen in FIGS. 6 and 7. During this movement a split ring 52, which resides in an annular groove 54 on the outer surface of the packoff body 14 and functions to prevent accidental axial movement of the landing ring 18 with respect to the body 14, is cammed outwardly from the groove 54 to release the ring 18 so that the body 14** can continue its downward movement as described above.

Figure 6:
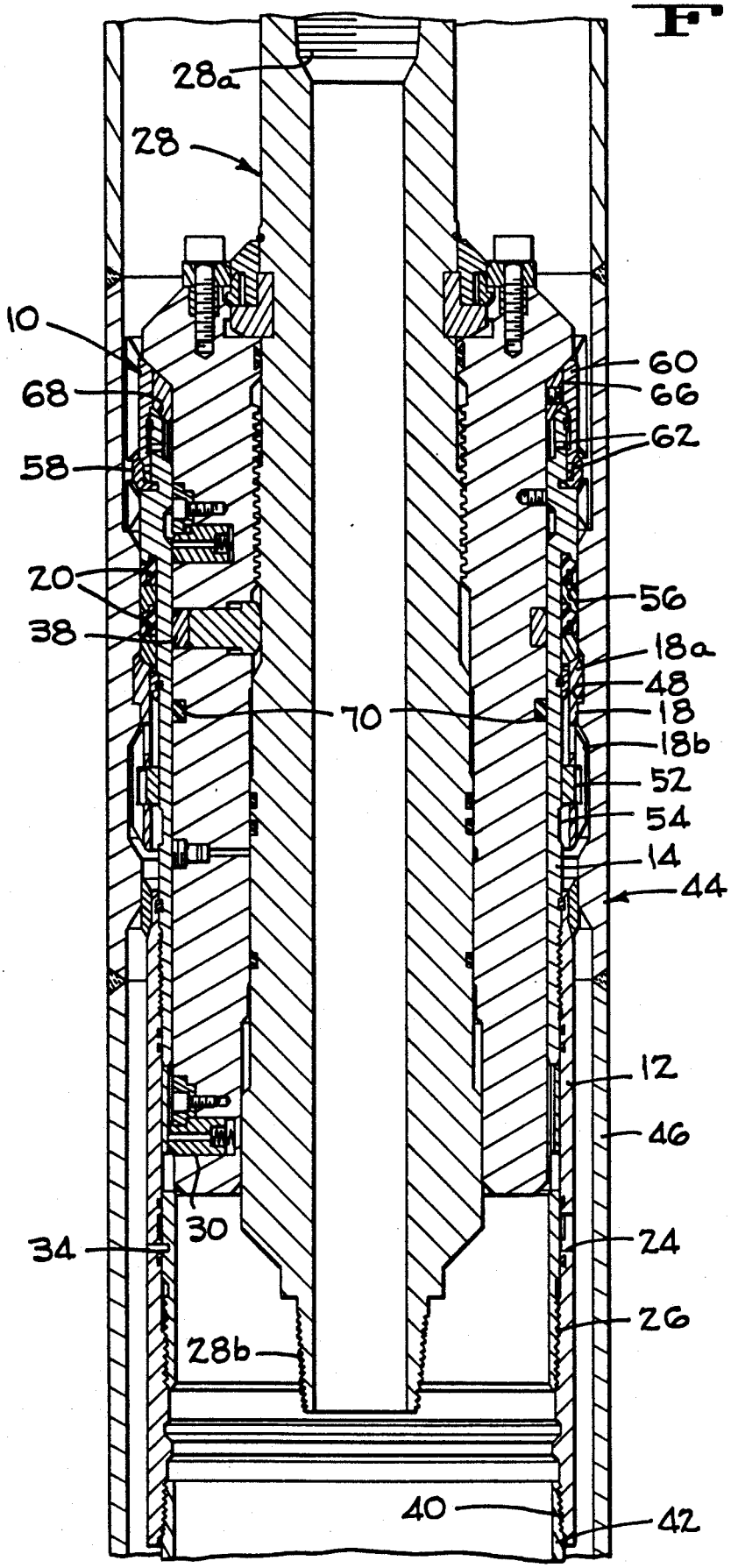
FIG. 6 is a view like FIG. 4 showing the hanger/packoff landed in the housing adapter and pressure tested.
Figure 7:
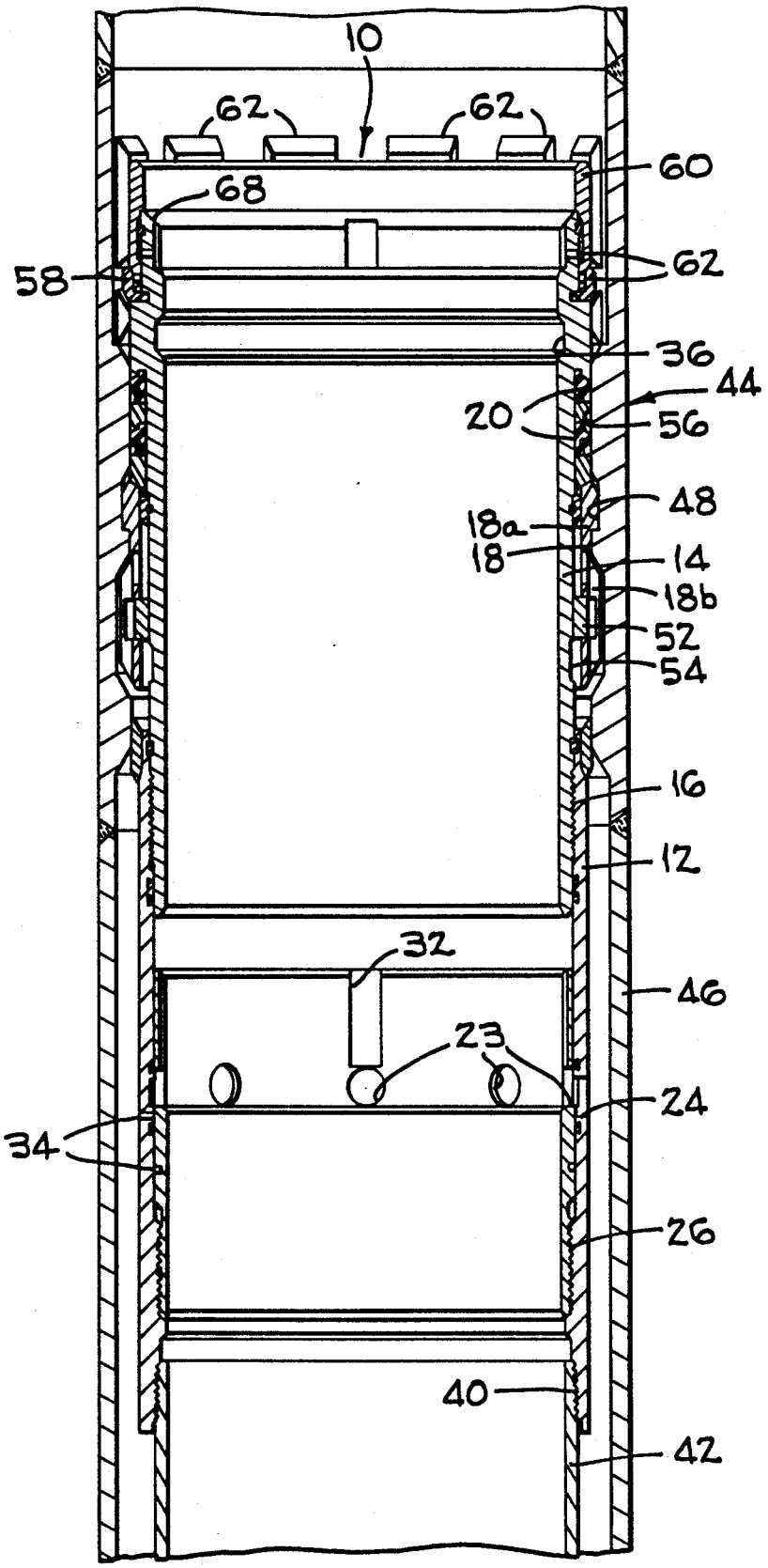
FIG. 7 is a view like FIG. 6 with the running tool removed and the porting valve sleeve in its open position.

Above the landing groove 48 is an inner cylindrical surface 56 that cooperates with the annular seals 20 on the packoff body 14 to establish a fluid pressure seal when the hanger/packoff 10 is properly installed in the adapter housing 44 (FIGS. 6 and 7).

Figure 4:
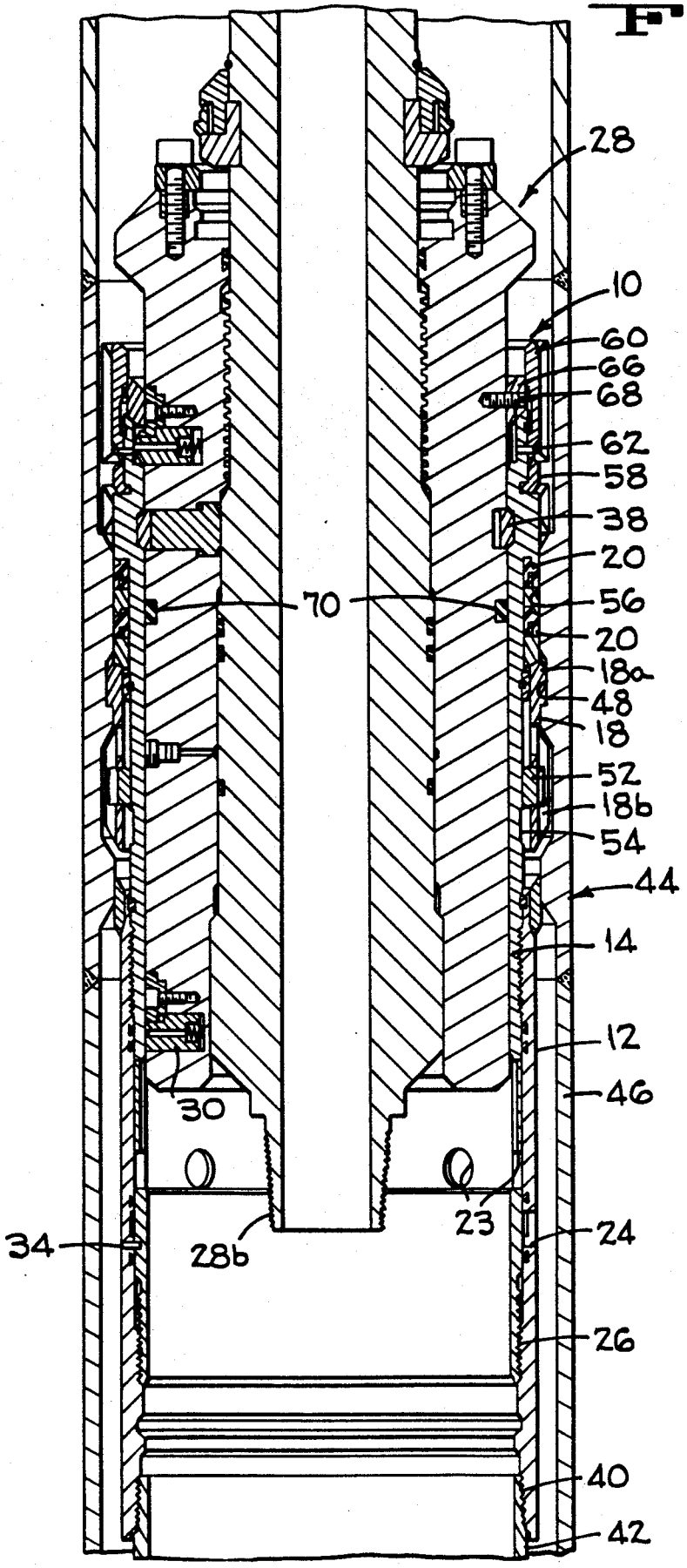
FIG. 4 is a view in central vertical section of the hanger/packoff attached to the running tool and landed on the housing adapter located in the outer casing string.
Figure 5:
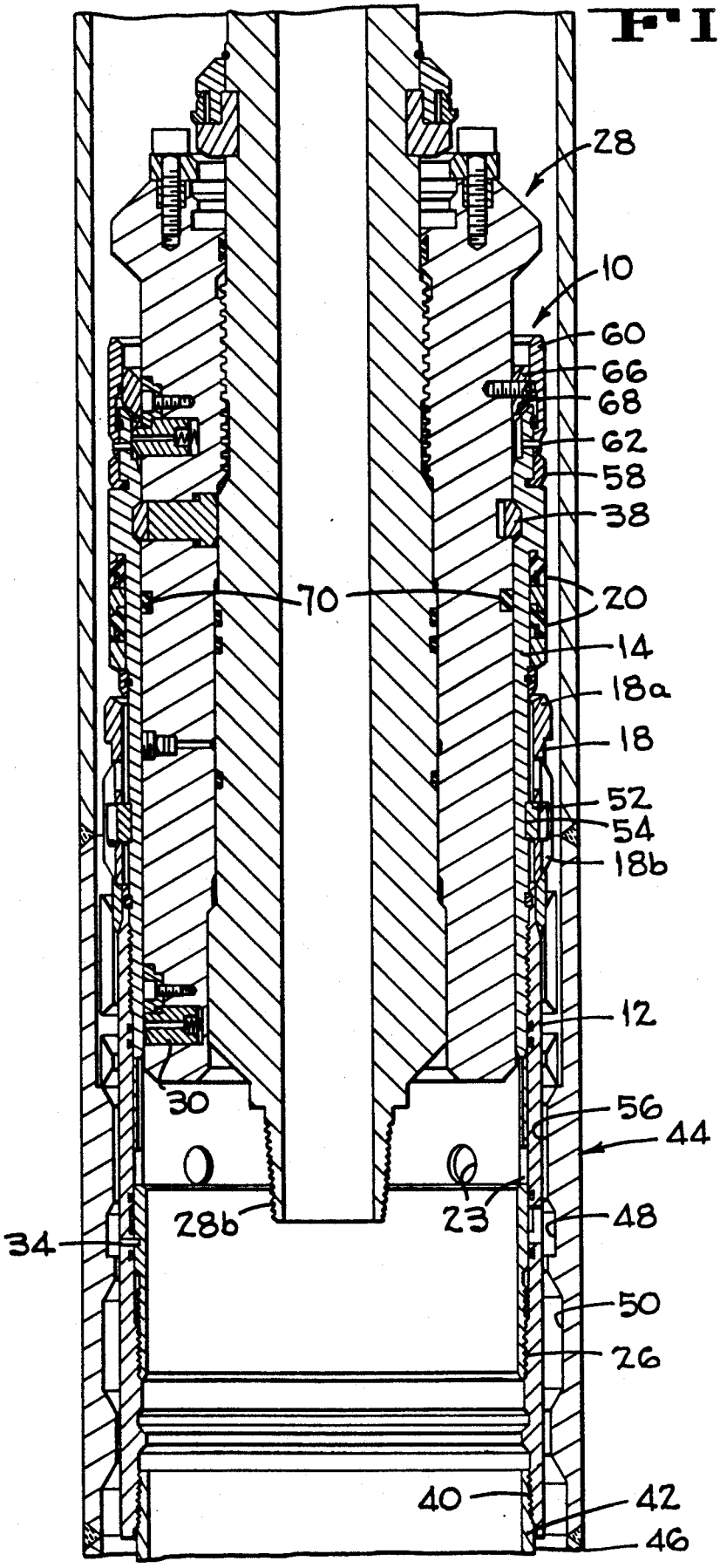
FIG. 5 is a view like FIG. 4, but showing the hanger/packoff lifted off the housing adapter during cementing operations.

Surrounding the packoff body 14 near its upper end is a split lock ring 58 that is expanded from its "unlocked" position (FIGS. 1, 5 and 6) into its "locked" position (FIG. 7) by an annular mandrel 60 upon downward movement of the running tool 28 from its FIG. 4 position into its FIG. 6 position. In its "locked" position the ring 58 cooperates with a plurality of internal projections or lugs 62 at the upper end of the adapter housing 44 to lock the hanger/packoff 10 against upward movement in the housing. The mandrel 60 is releasably secured to the packoff body 14 by shear pins 62 which fracture when the weight of the running tool 28 is imposed on the mandrel to cause its downward movement.

RUNNING PROCEDURE

When the running tool 28 has been secured to the lower end of a drill pipe or similar running string (not shown) by means of its upper internal threads **28*a*, and a cement wiper plug (not shown) has been attached to the lower end of the tool by threads 28*b*, the tool is stabbed into the hanger/packoff 10 until a positioning ring 66 on the tool 28 lands on the shoulder 68 at the upper end of the packoff body 14 (FIG. 4**). The running string is then rotated to the left (i.e. counterclockwise as viewed from above) for three turns, and an overpull on the string is taken to confirm that the tool is locked into the hanger/packoff.

The hanger/packoff is then lowered through the blowout preventer (BOP) stack and wellhead (neither shown), during which the landing ring 18 will contract and pass through the BOP stack and other wellhead elements. Lowering is continued, and when the landing ring reaches the adapter housing grooves 48, 50 the ring will expand and engage the shoulder **48*a*. Rig support of the running string is then slacked off until the weight of the liner 42 causes the split ring 52 to expand out of its groove 54, facilitating downward movement of the hanger/packoff 10 with respect to the landing ring 18 and ring 52 until the position shown in FIG. 4 is reached. In this position the weight of the liner 42 and hanger/packoff is imposed through the seals 20 and the landing ring 18 on the adapter housing 44, thereby forcing the seals into pressure tight contact with the housing to establish the desired hanger/packoff-to-housing seal. At this point the hanger/packoff 10** can be pressure tested before commencement of the cementing operation, if desired.

The running string is then picked up to raise the hanger/packoff 10 into its position shown in FIG. 5, and held in this position while cementing operations are performed. During this step of the procedure the cement is pumped down the liner 42, out of the liner's open lower end (not shown), and then up the annulus between the liner and the well bore. Immediately after cementing, the hanger/packoff is lowered and landed in the adapter housing as shown in FIG. 4.

The running tool is then rotated three turns to the right to release it from the hanger/packoff 10, and the tool can then be picked up and fluid circulated through the well to ensure there is no cement around the tool. The tool is then lowered to re-engage it with the hanger/packoff for pressure testing, which testing can be performed before the cement has set.

The drill pipe BOP rams (not shown) are then closed and test pressure applied. The annular resilient seal 70 establishes a pressure barrier between the tool and the hanger/packoff bore, and fluid returns up the running string indicate the seal is leaking. Loss of pressure with no returns indicates the annulus seals 20 on the hanger/packoff are leaking.

If no seal leakage is observed, the running tool is then removed from the hanger/packoff and retrieved from the well by simply lifting straight up on the running string.

If a successful pressure test cannot be achieved, the applied pressure is bled off and the drill pipe rams are opened. The running tool (FIG. 6) is then rotated to the left, likewise rotating the porting sleeve 22, to which it is non-rotatably connected by the key 30 and a cooperating porting sleeve slot 32, and causing the sleeve to move downwardly. This downward sleeve movement aligns the sleeve's ports 23 with the hanger body ports 24 (FIG. 7), thus providing access to the annulus between the liner and the surrounding casing. The running tool is then lifted a desired distance from the hanger/packoff and cement is squeezed between the liner and casing.

Although the best mode contemplated for carrying out the present invention has been herein shown and described, it will be apparent that modification and variation may be made without departing from what is regarded to be the subject matter of the invention.

We claim:

1. A hanger/packoff assembly for supporting an inner well casing in an outer well casing at a position beneath a wellhead, comprising;

(a) a hanger body with at least one radial port, (b) a packoff body connected to the upper end of said hanger body, (c) support means surrounding the packoff body above said hanger body for landing and supporting the hanger/packoff assembly in a well casing element, (d) annular seal means surrounding the packoff body above the support means for establishing a pressure seal between said packoff body and an outer well casing, and (e) a sleeve valve within and rotatably connected to the hanger body, said sleeve valve having at least one radial port which, upon rotation of said valve with respect to said hanger body, moves between a first position wherein the hanger body port is closed and a second position wherein said hanger body port and said sleeve valve port are in communication to control fluid circulation between the bore and the exterior of the hanger body.

2. A hanger/packoff assembly according to claim 1 wherein the support means includes an expandable split ring.

3. A hanger/packoff assembly according to claim 2 including means positionable in an outer well casing to cooperate with the expandable split ring for establishing support of said assembly in said outer well casing.

4. A hanger/packoff assembly according to claim 3 wherein the positionable means comprises an annular housing adapter having at least one inner radial groove into which at least a portion of the expandable split ring resides when said assembly is properly landed in said adapter.

5. A hanger/packoff assembly according to claim 1 including means to releasably secure the sleeve to the hanger body against relative rotation with respect thereto.

6. A hanger/packoff assembly according to claim 1 including means to releasably interconnect said packoff body to a running tool for withdrawing said running tool from said packoff body following setting of said annular seal means into functional position against an outer well casing.

7. A hanger/packoff assembly according to claim 1 including means to lock said assembly into an outer well casing against upward movement therein.

8. A hanger/packoff assembly according to claim 1 including means to force the annular seal means into pressure tight contact with an outer well casing.

9. A hanger/packoff assembly according to claim 1 including means to releasably connect a running tool to said sleeve valve for rotating said valve with respect to said hanger body.

* * * * *